US005360144A

United States Patent [19]

Slade

[11] Patent Number: 5,360,144

[45] Date of Patent: Nov. 1, 1994

[54] DISPENSING MEANS FOR SIMULTANEOUSLY DISPENSING TWO LIQUIDS

[75] Inventor: Brian P. Slade, Ashford, Great Britain

[73] Assignee: Unilever Patent Holdings B.V., Rotterdam, Netherlands

[21] Appl. No.: 41,464

[22] Filed: Apr. 2, 1993

[30] Foreign Application Priority Data

Apr. 2, 1992 [GB] United Kingdom ..... 9207292.5

[51] Int. Cl.[5] ..... B67D 5/60

[52] U.S. Cl. ..... 222/134; 222/145; 222/212; 417/183; 417/187; 417/197; 239/458; 137/891

[58] Field of Search ..... 222/94, 134, 145, 251, 222/212; 239/458; 137/891, 892; 417/183, 187, 197

[56] References Cited

U.S. PATENT DOCUMENTS

| | | | |
|---|---|---|---|
| 2,692,564 | 10/1954 | Miller | 417/183 X |
| 3,135,428 | 6/1964 | Gallo . | |
| 3,338,173 | 8/1967 | Gunzel, Jr. et al. | 137/891 |
| 3,357,598 | 12/1967 | Kraft | 222/134 |
| 3,643,688 | 2/1972 | Meinert | 417/183 X |
| 3,876,111 | 8/1975 | Swain . | |
| 4,271,984 | 6/1981 | Ducros et al. | 222/94 |

FOREIGN PATENT DOCUMENTS

| | | |
|---|---|---|
| 2229047 | 6/1974 | France . |
| 9112317 | 1/1992 | Germany . |
| 209920 | 1/1924 | United Kingdom . |
| 813514 | 5/1959 | United Kingdom . |

*Primary Examiner*—Gregory L. Huson
*Attorney, Agent, or Firm*—Cushman, Darby & Cushman

[57] ABSTRACT

Dispenser for dispensing simultaneously two liquids held in respective flexible containers, one within the other. Concentric tubular passages are provided for flows of the liquids from their containers when pressure is applied to the outer container. The inner passage has a narrow elonage form and terminates within the outer passage a final exit section of which provides a common conduit for both flows. A reduced liquid pressure is produced at the inner passage termination by having a tapered upstream end of the conduit overlapping the termination and the conduit is configured to inhibit mixing of the flows along its length. The two liquids are thus dispensed in a single stream in which, e.g., a colored flow from the inner passage is visible in the core of the stream. By adjusting the position of the conduit taper relative to the inner passage termination, it is possible to vary the proportions of the two components in the flow.

22 Claims, 2 Drawing Sheets

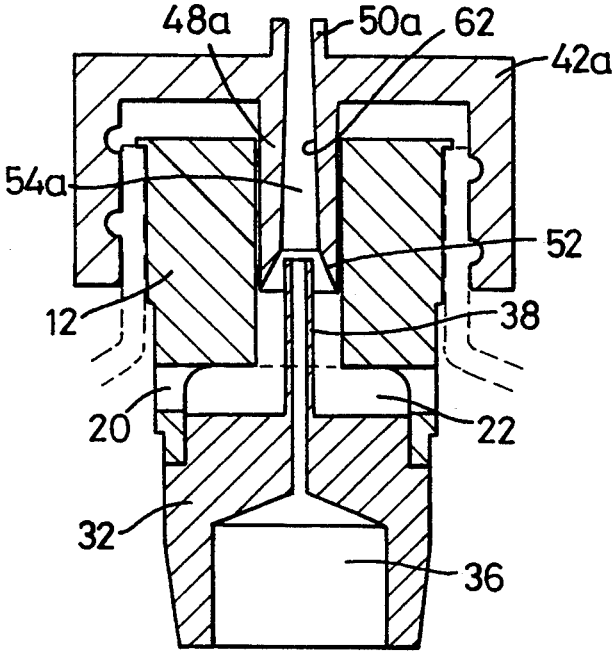
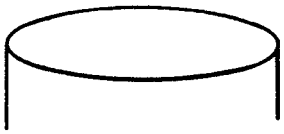
Fig. 3
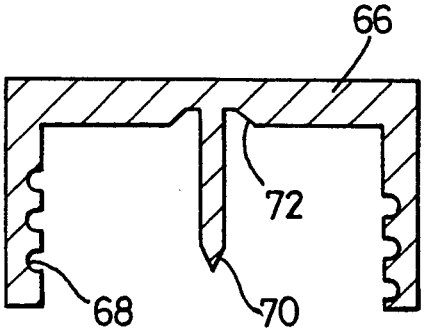
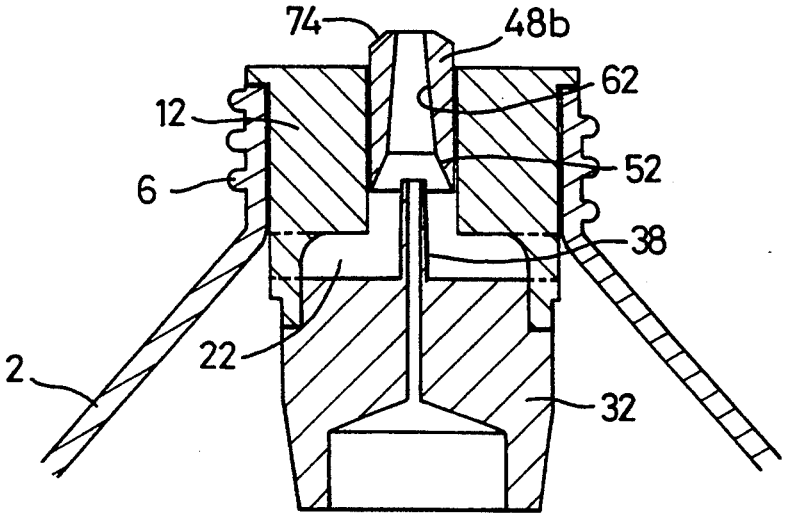
Fig. 4
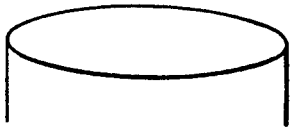

DISPENSING MEANS FOR SIMULTANEOUSLY DISPENSING TWO LIQUIDS

BACKGROUND OF THE INVENTION

This invention relates to means for simultaneously dispensing two liquids which are held in separate spaces within a container, preferably in a manner that allows the relative proportions of the liquids dispensed to be varied.

Such dispensing means are known in which one liquid is held in a main outer container within which there is a secondary inner container, holding the other of the two liquids. The fluid-holding spaces of both containers can communicate with a common outlet and both containers are pressure-deformable, so that squeezing the outer container pressurizes the contents of both to discharge the two liquids together through the common outlet.

These known dispensing means include that shown in GB 1241985 in which a dispensing unit is mounted in the neck of an outer container holding a base solution, the unit itself comprising an annular secondary container fitting within the main container to seal with the inside wall of the container neck. The annular container forms a central passage open at its inner end to the main volume of the outer container and at its upper end to an outlet nozzle in the centre of a cap screwed onto the neck of the main container. A pair of concentric cylindrical sleeves formed integrally with the secondary container project from that container towards the screw cap outlet nozzle. The sleeves define an annular space into which the liquid in the secondary container can flow through apertures in the bottom wall between the pair of concentric sleeves. An internal cylindrical collar on the cap protrudes into the annular space formed by the sleeves and forms a sliding seal with the inner face of the outer of those sleeves. The collar has a chamfered end opposed to the end of the inner sleeve and forms therewith a restriction in the path of flow from the annular space to a mixing chamber preceding the outlet nozzle.

When the main container is inverted and squeezed, the base solution flows through the central passage surrounded by the secondary container to the mixing chamber. At the same time the hydrostatic pressure in the main container forces liquid from the secondary container through the annular space to mix with the main fluid in the mixing chamber before the combined liquids issue from the outlet nozzle. The mixing is promoted by the widening of the flow passages following the restriction in the path of the secondary container fluid and complete mixing is further ensured by vanes in the flow passage immediately preceding the outlet nozzle. By screwing the cap in to a greater or lesser extent, the restriction is made more or less pronounced and the proportion of secondary liquid to main liquid is correspondingly reduced or increased.

In U.S. Pat. Nos. 3,217,931 and 3,289,887 further two-fluid dispensing means are described. These include devices in which, before they are discharged, the flows of two liquids become thoroughly mixed in a mixing space formed between an outlet nozzle of the device and a series of internal orifices through which the individual fluids are discharged from respective containers. Further devices described in U.S. 3,217,931 discharge the fluids in separate streams with no intermixing until after they have left the container. The various forms of device described in these two specifications do not have the ability to vary the proportions of the fluids being dispensed. A similar fixed ratio dispensing device which also ejects streams of the two liquids side by side is described in GB 965508.

Further examples of means for dispensing two fluids together are shown in U.S. Pat. No. 3,876,111 which has a number of small metering slots for the main fluid while the secondary fluid flow takes place past a central plug mounted in a screw cap of the device. By unscrewing the cap the plug is displaced to leave a narrow annular flow channel to an exit chamber into which the metering slots also open. Mixing of the flows is thus promoted before they are discharged. It is described how, by adjusting the screw cap, it is possible to open more or fewer slots to vary the proportions of the two fluids. In each case the fluids are metered through relatively narrow passages into a larger space or plenum before they are discharged through an outlet nozzle so that turbulent mixing is promoted.

Other examples of dispensing means in which two liquids are mixed before ejection can be found in GB 1107873.

The prior mixing of the two liquids before discharge in these known multi-fluid dispensing means has practical advantages for many typical liquids dispensed. The minor constituent is typically a concentrate or additive and direct contact with it before dilution may be undesirable. In the prior art in which the two liquids escape side by side, whether as a single jet or in separate jets, it may be necessary to exercise considerable care to avoid concentrate falling where it may be harmful or unpleasant. Particularly where the dispensers are used for consumer products, safety and consumer acceptability may thus make it necessary to ensure thorough mixing of the two fluids before discharge.

If these known devices mix two liquids having a different appearance, the hue of the mingled flow is an indication of their relative proportions, which could be particularly useful if the dispensing device permits the proportions to be varied. For consumer products, however, which must allow for the unskilled use of the dispensers by a wide variety of individuals, some possibly with imperfect vision, it is difficult to ensure that the appearance of two mixed liquids can indicate sufficiently clearly their relative proportions. It is particularly difficult if one of the fluids forms only a very small part, e.g. 1–2%, of the mixture.

SUMMARY OF THE INVENTION

According to one aspect of the invention, there is provided a dispensing means for simultaneously dispensing two liquids from a common outlet and comprising respective tubular passages, one within the other, each having inlet means for a respective one of the liquids, the inner of said tubular passages terminating within the outer passage at a spacing from said outlet and the outer tubular passage providing a common conduit for flows of both liquids between said inner passage termination and the outlet, the common conduit having an upstream portion of reducing cross-section positioned or positionable to overlap the termination of the inner passage and followed by elongate outlet portion arranged to inhibit mixing of the flows of liquid along its length.

Such a device may be constructed as a unit for attachment to a container, the unit possibly further comprising a secondary container to be located within and subject to the pressure in the first-mentioned container. Alternatively, the device can form an integral part of a container holding the respective fluids separately.

In accordance with another aspect of the invention there is therefore provided dispensing means comprising an outer container for a first liquid and an inner container disposed within the outer container for a second liquid, the two containers each having flexible walls whereby a pressure applied to the outer container walls can be applied to the liquids in both containers, two tubular passages one within the other communicating with the respective containers for conducting the liquids from said containers towards a common outlet, the inner of said passages terminating at a spacing from said outlet, the portion of the outer passage downstream thereof forming an elongate common conduit for both fluids, said conduit having an upstream portion of reducing cross-section positioned or positionable at the termination of the inner passage and followed by an elongate outlet portion arranged to inhibit mixing of the flow of the liquids along its length.

By injecting one of the liquids as a stream within the other as they both flow towards the outlet from the dispensing means and by ensuring that the passage available to this combined flow of fluids does not have any divergence that might disturb the flow before the liquids reach the common outlet, it is found that it is possible to keep the two liquids unmixed to any significant extent as they emerge from the device. To maintain this condition the passage may have a constant cross-section, but preferably is tapered, although less sharply so than said tapered region. By maintaining the separation of the liquids there is one distinct advantage in that the presence and the relative proportions of each of the two liquids can be made immediately visible if they each have a different appearance—in particular if the inner of the two streams is coloured and the outer substantially translucent.

This is especially useful if means are provided to vary the relative proportions of the two liquids since an immediate indication of their proportions is given to the user without the need for skill or judgement, or indeed for any great acuity of vision such as might be needed if the flows were intermingled.

The flows may of course soon intermingle after leaving the dispensing means but that is generally to be desired, particularly if one of the components is, for example, an additive which should only make contact after dilution. In fact the dispensing means of the invention are well adapted for use with such fluids because although the flows are separate as they emerge, they can be formed as an inner stream of one fluid entirely surrounded by an annular stream of the other fluid. By making the additive or the like the inner stream it will not be deposited anywhere except in the presence of the other fluid also.

In a preferred arrangement for varying the proportions of the two flows, the common conduit comprises, over at least a part of its length, an axially adjustable tubular member having a progressive restriction at an upstream end which overlaps the termination of the inner passage to a variable extent by the adjustment of the tubular member. Such a restriction can act as a variable venturi which, depending upon its axial adjustment, will change the static pressure into which the flow from the inner passage emerges, the lower the static pressure the greater the flow from the inner passage.

It can be arranged that the fluid flow along the inner passage is subjected to a greater pressure drop than is the flow of the other constituent of the two fluids, to such an extent that the removal of the venturi effect by adjustment of the restriction position effectively brings the inner passage flow to a stop, so that it is also possible to dispense fluid without the additive.

In addition to the prior art already referred to, it may be mentioned here that means have also been proposed for dispensing two-component mixtures of semi-solid or paste-like materials. In GB 209920 for instance, a dispenser directly analogous to that in GB 965500 is described for bringing two paste-like components separately to the container outlet.

In another example, U.S. Pat. No. 3,135,428 describes a means for dispensing a ribbon of paste consisting of a main body of one component and a coating of a second component along the outer surface of the ribbon. The coating material is ejected along a series of channels to an outlet tube into which the main component is expressed simultaneously. The flow passage for the second component widens as it leaves the channels to join the main component but because of its semi-solid nature it remains a coherent mass which may be deformed hydrostatically to form a more or less uniform coating on the main component. Such a result could not be obtained with liquids because of the turbulent mixing that could occur as the second component left its channels and as the two flows came together.

A similar arrangement for dispensing two pastes is described in GB 1466721 in which an adjustable restrictor at the outlet end of the channels for the second component allows the proportions of the two components to be varied. The adjustable restrictor forms an additional obstruction in the path of the flow to the common outlet conduit which would increase turbulence and mixing if liquids were being dispensed rather than semi-solids.

There may also be mentioned DE-U-9112317 which describes a dispenser for two-part adhesives or other paste-like components. A container has coaxial chambers formed by a pair of concentric tubes in which the components are held and a plunger is secured to respective pistons which slide in the chambers. Movement of the plunger forces the two components from the chambers through coaxial outlets into a common delivery tube containing a spiral for the thorough intermixing of the materials. In this example, therefore, even in the case of pastes there is intimate mixing of the components in the dispenser. Furthermore, the amount of material dispensed is determined solely by the displacement of the plunger so that only the relative cross-sectional sizes of the chambers determine the proportions of the two components and, of course, the relative pressures of the components as they leave their chambers will depend on the proportions of the mixture. If used with more free-running materials, therefore, the uncontrolled pressure differences can intensify the mixing of the components.

The invention will be further described by way of example with reference to the accompanying diagrammatic drawings.

BRIEF DESCRIPTION OF THE DRAWINGS

FIG. 3 is a sectional view of a modified form of the dispensing means, FIG. 4 illustrates another modified form of the dispensing means as a fixed-ratio device.

DESCRIPTION OF THE PREFERRED EMBODIMENTS

Figure 1:
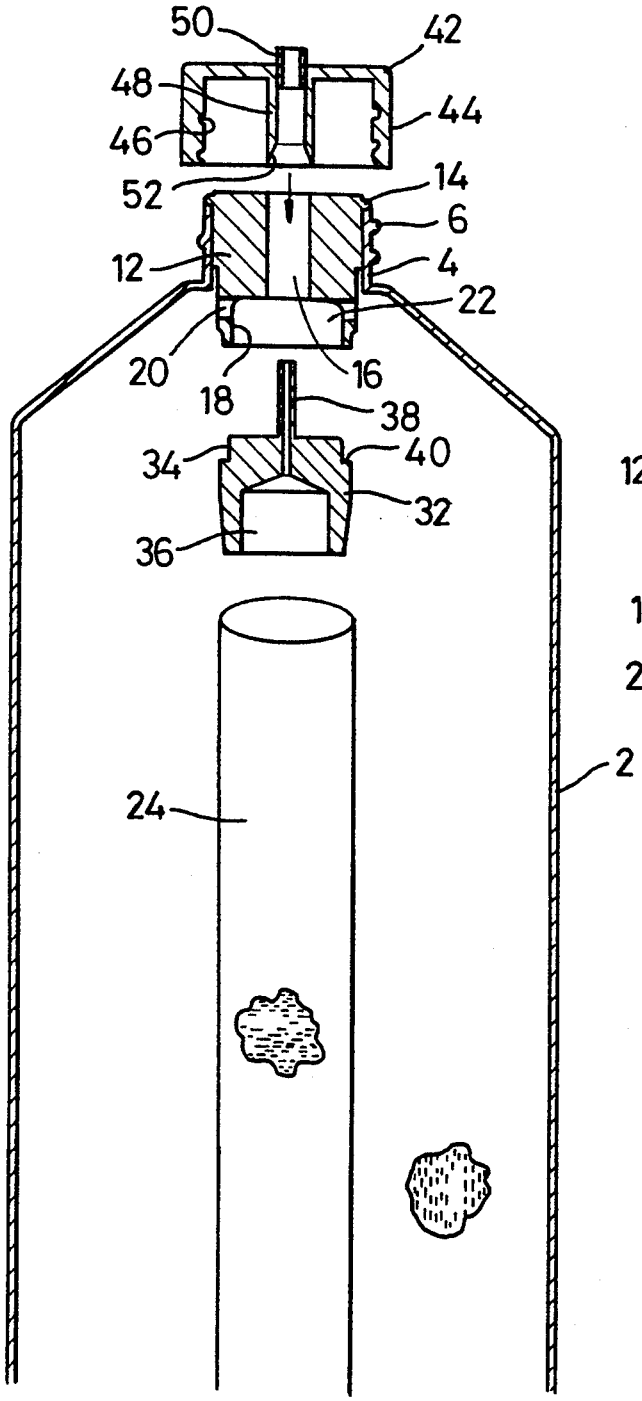
FIG. 1 is an exploded illustration of one form of dispensing means according to the invention in a container.
Figure 2:
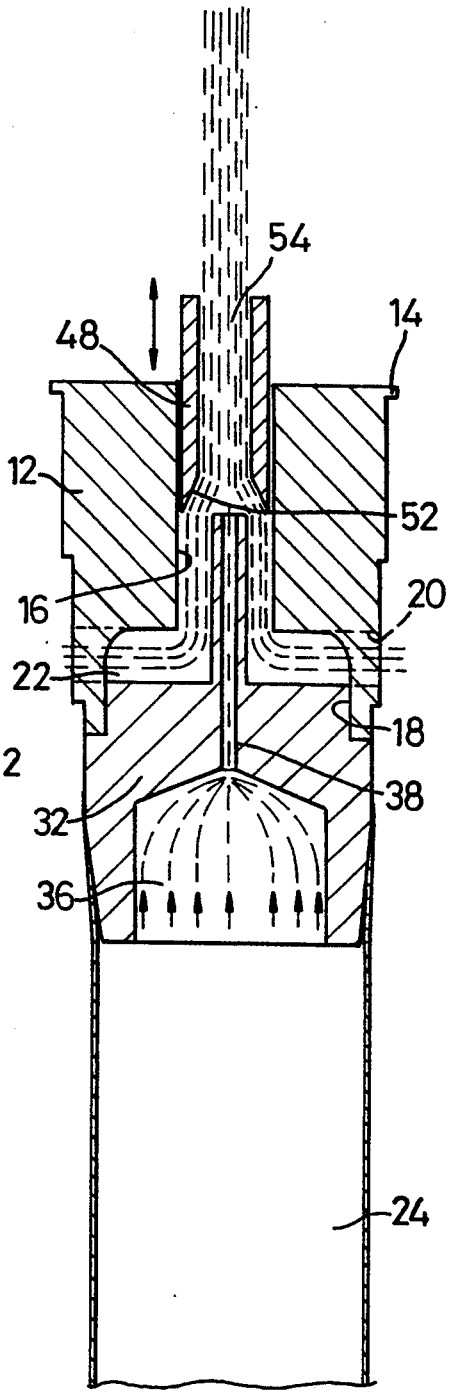
FIG. 2 illustrates the flows through the dispensing means of FIG. 1 in operation.

FIG. 1 illustrates a main container 2 made of a flexible material, e.g. a plastics blow-moulding, having an open neck 4 with a screw thread 6 on its outer face. A tubular plug 12 fits within the neck 4; the plug seals against the inner face of the neck, and has a locating rim 14 which bears on the top of the neck. The plug has a central bore 16 extending from its top face and joining a concentric counterbore 18 extending from the bottom face. A series of radial ducts 20 are provided through the side walls of the plug to a chamber 22 (FIG. 2) in the upper region of the counterbore.

An elongate collapsible sac 24 of flexible material is sealed at its lower end (not shown) and its upper end is secured sealingly onto the tapered periphery of an injector head 32. The outer periphery of the head is stepped and the smaller diameter portion 34 of the step fits into and seals with the lower region of the counterbore 18, below the ducts 20. An outlet passage 36 for the contents of the sac is formed centrally in the injector head and is extended through an elongate outlet tube 38 integral with the head. When the head is fitted into the counterbore 18 with shoulder 40 abutting the plug 12, the tube 38 projects concentrically along part of the length of the central bore 16.

The container has a cap 42 with a dependent skirt 44 on which there is an internal screw thread 46 engaging the thread 6 of the container neck. A cylindrical inner sleeve 48 of the cap is coaxial with the skirt and a tubular insert 50 is located centrally in the top of the sleeve to form reduced diameter outlet nozzle. The nozzle may be provided with a replaceable top closure (not shown). Below the nozzle the sleeve 48 extends downwards to terminate adjacent the elongate outlet tube 38. At its lower end near the outlet tube 38, the internal diameter of the sleeve is progressively widened by a tapered end portion 52. The sleeve 48 fits the bore 16 closely so as to seal with its wall but it is displaceable axially of the bore by rotation of the screw threaded cap 42 on the threaded engagement 6.

In use, the main volume of the container 2 is filled with a liquid to be dispensed and the sac 24 with a liquid additive which is to be dispensed with the main fluid but in smaller quantities. When pressure is applied to the walls of the container 2, the main liquid is forced through the radial ducts 20, the chamber 22 and the bore 16. The hydrostatic pressure also acts on the sac 24 to urge the additive liquid through the passage 36 and tube 38. The sleeve 48 forms a smooth-walled common conduit 54 to the outlet nozzle 50 for the main liquid flow and any additive from outlet tube Referring more particularly to FIG. 2, it can be seen that the main fluid entering the plug chamber 22 is accelerated as it flows radially inwards and it then continues along an essentially constant cross-section elongate annular passage in the bore 16 around the tube 38. This arrangement ensures that the flow is relatively uniform and free from turbulence as it passes the outlet of the tube 38. The sleeve 48 and nozzle 50 provide an uninterrupted path which tends to maintain laminar flow of the liquids, and so inhibit them from mixing before they leave the dispenser.

The tube 38 has a length that is several times its internal diameter, approximately fifteen times in the illustrated example but preferably at least five times that diameter. The narrow elongate form of the tube 38 has a restricting effect on the flow of additive in comparison with the relatively large cross-section for the main liquid flow around it. When the main fluid is forced out by squeezing the walls of the container, the same hydrostatic pressure is applied to the sac 24, but the restriction afforded by the narrow outlet tube 38 produces a pressure loss in that tube. In the state shown in FIG. 2, in which the sleeve 48 is at some distance from the tube 38, the pressure differential at the termination of the tube may be sufficient to prevent any flow of the fluid from the sac through the tube. Downstream from the outlet tube 38 the tapered end portion 52 of the sleeve creates a venturi effect and the static pressure of the main liquid flow is correspondingly reduced. If the cap 42 is screwed down on the container neck to bring the tapered portion 52 of the sleeve opposite the termination of the tube 38, the lowered main liquid pressure at the tube outlet allows the additive to flow through the tube to join the main flow. It will be understood that the adjustment of the screw cap can produce a progressive change of pressure at the tube outlet, so that the rate of flow of the additive can be controlled to vary the relative proportions of the main and additive flows.

Since the common outlet conduit cross-section does not increase in the direction of flow, it is possible to minimise any turbulence which would mix the flows and they can be are kept substantially separate until they leave the device. The length of the common conduit 54 is preferably at least twice its internal diameter, so that a laminar flow pattern tends to be encouraged to assist this effect. The additional restriction formed by the insert 50 limits the combined rate of flow but is designed not to disturb the flow pattern.

If the additive liquid has a different appearance from the main fluid, for example, if a coloured additive is employed with a substantially colourless main liquid, it is easy for the user to see not only that the additive is being dispensed, but also to gauge the relative proportions of the two liquids the relative breadths of the two streams. Of course, once the liquids have left the outlet nozzle, the streams soon mix together but their separation can be maintained sufficiently clearly to give these visible effects as they emerge from the nozzle.

Changing of the proportions of the two flows by screwing the cap up and down need not alter the flow pattern described above as it is possible to obtain a stable separation of the liquids in the common outlet conduit over a wide range of adjustment. In this first embodiment, the main liquid may be a bleach solution and the additive a perfume which can be included at a rate of up to $1\frac{1}{2}$–2% of the main flow by use of the dispensing means in the manner described.

FIG. 3 illustrates a modified form of dispensing means which can be employed in a similar manner to the first example. It differs from the first example essentially only in that cap 42*a* comprises a sleeve 48*a* has a continuing taper 62 following the more sharply tapered venturi section 52. The taper 62 provides a smoothly tapered outlet conduit 54*a* ending at the appropriate diameter outlet nozzle 50*a*. The continuous taper 62 can help stabilize the flow to prevent mixing of the two liquids.

In some applications it may not be necessary to provide for adjustment of the proportions of the fluids. Such an arrangement is shown in FIG. 4 where the parts already described are indicated by the same reference numbers. In this example a closure cap 66 is also shown, with an internal screw thread 68 engaged by the container neck screw thread 6. An integral spear 70 projects downwards from the centre of the cap and is a close fit in sleeve 48*b* which is now separate from the cap and is fixed in or integral with the plug 12. The tip of the spear bears on the end of the tube 38 when the cap is screwed down to seal the tube outlet. A conical depression 72 surrounding the spear 70 mates with the conical outer face 74 of the sleeve when the cap is screwed down and in combination with the spear provides a liquid-tight seal. The cap therefore seals the common outlet of the two liquids and also keeps the two liquids apart until use.

The dispensing means can be made in a relatively economical manner. The examples illustrated show the means a self-contained unit which may be arranged to be inserted into the pouring neck of a standard container. The container then becomes a directable pressure dispenser instead of a pouring dispenser.

I claim:

1. Dispensing means for simultaneously dispensing two liquids, comprising a pair of tubular passages, one within the other, each tubular passage having an inlet and an outlet for a respective one of said two liquids for flow of both liquids from the dispensing means;

the outlet of the inner of the tubular passages being disposed within the outer tubular passage at a spacing from the outlet of said outer passage;

a common conduit being provided by said outer passage between the respective outlets of the inner and outer passages for the flows of both liquids whereby said outer passage outlet serves as a common outlet for both flows;

the common conduit comprising an elongate downstream portion having an uninterrupted interior with a cross-section that reduces in size in the direction of fluid flow, whereby to inhibit mixing of the flows of said two liquids along its length, an upstream portion of the common conduit extending between said downstream portion and the inner tubular passage, said upstream portion having a cross-section that reduces in size in the direction of fluid flow, said reductions of cross-section of the upstream and downstream portions being at a greater rate over the length of the upstream portion than over the length of the downstream portion, said reduction of cross-sectional size of the upstream portion of the common conduit forming part of a continuing reduction of cross-sectional size of the outer tubular passage overlapping the outlet of the inner tubular passage.

2. Dispensing means according to claim 1, wherein said upstream portion is fixed in said overlapping location relative to said inner passage outlet.

3. Dispensing means according to claim 1, wherein the common conduit is displaceable relative to said inner passage outlet in the direction of liquid flow.

4. Dispensing means according to claim 1 further comprising a flexibly deformable sealed liquid container for the first of said liquids communicating with the inner tubular passage and forming therewith a preassembled unit for insertion into a mouth of a flexibly deformable container with said outer passage in communication with said container for the admission of the second of said liquids.

5. Dispensing means according to claim 1, wherein the outer tubular passage has a larger cross-sectional area than that of the inner tubular passage and the length of said inner passage is at least several times its diameter.

6. Dispensing means according to claim 1, wherein each said tubular passage has an elongate portion immediately upstream of the outlet of the inner tubular passage, along said elongate portion there being no substantial increase in cross-sectional area for the flow therein.

7. Dispensing means according to claim 1, wherein the length of the elongate outlet portion of the common conduit is at least twice its minimum internal diameter.

8. Dispensing means according to claim 1, wherein an axially adjustable sleeve member forms a bounding wall of at least part of the length of the said common conduit.

9. Dispensing means according to claim 8, wherein an upstream end portion of said sleeve member provides the said portion of reducing cross-section.

10. Dispensing means according to claim 9, wherein said sleeve member is axially adjustable between said location in which said upstream end portion overlaps the inner passage outlet and a further location in which it is spaced downstream from said outlet.

11. Dispensing means according to claim 8, comprising a screw threaded carrier on which said sleeve member is mounted for said axial adjustment of the sleeve member by rotation of the carrier.

12. Dispensing means for simultaneously dispensing two liquids, comprising outer and inner flexible-walled containers for a first and a second of said two liquids respectively, the inner container being disposed within the outer container whereby the application of pressure to the flexible walls of the outer container to express the first liquid therefrom also transmits pressure to the flexible walls of the inner container to express the second liquid therefrom simultaneously, the dispensing means further comprising a tubular outer exit passage communicating with said outer container and a tubular inner exit passage communicating with the inner container, each said passage having an inlet and an outlet for a flow of its respective liquid, the outlet of the inner of the tubular passages being disposed within the outer tubular passage at a spacing from the outlet of said outer passage;

a common conduit being provided by said outer passage between the respective outlets of the inner and outer passage outlet serves as a common outlet for both flows;

the common conduit comprises an elongate downstream portion having a cross-section that reduces in size in the direction of fluid flow, whereby to inhibit mixing of the flows of said two liquids along its length, an upstream portion of the common conduit extending between said downstream portion and the inner tubular passage, said upstream portion having a cross-section that reduces in size in the direction of fluid flow, said reductions of cross-section of the upstream and downstream portions being at a greater rate over the length of the upstream portion than over the length of the downstream portion, said reduction of cross-sectional size of the upstream portion of the common conduit forming part of a continuing reduction of cross-sectional size of the outer tubular passage overlapping the outlet of the inner tubular passage.

13. Dispensing means according to claim 12, wherein said upstream portion is fixed in said overlapping location relative to said inner passage outlet.

14. Dispensing means according to claim 12, wherein the common conduit is displaceable relative to said inner passage outlet in the direction of liquid flow.

15. Dispensing means according to claim 12, wherein the outer tubular passage has a larger cross-sectional area than that of the inner tubular passage and the length of said inner passage is at least several times its diameter.

16. Dispensing means according to claim 12, wherein each said tubular passage has an elongate portion immediately upstream of the outlet of the inner tubular passage, along said elongate portion there being no substantial increase in cross-sectional area for the flow therein.

17. Dispensing means according to claim 12, wherein the length of the elongate outlet portion of the common conduit is at least twice its minimum internal diameter.

18. Dispensing means according to claim 12, wherein an axially adjustable sleeve member forms a bounding wall of at least part of the length of the said common conduit.

19. Dispensing means according to claim 18, wherein an upstream end portion of said sleeve member provides the said portion of reducing cross-section.

20. Dispensing means according to claim 19, wherein said sleeve member is axially adjustable between said location in which said end portion overlaps the inner passage outlet and a further location in which it is spaced downstream from said outlet.

21. Dispensing means according to claim 18, comprising a screw threaded carrier on which said sleeve member is mounted for said axial adjustment of the sleeve member by rotation of the carrier.

22. Apparatus according to claim 1 wherein said reduction of cross-sectional size of the downstream portion of the common conduit comprises a stepped reduction spaced downstream from the inner tubular passage outlet.

* * * * *